United States Patent [19]

Gabbay

[11] 4,352,196

[45] Sep. 28, 1982

[54] X-RAY TUBE FOR PRODUCING A FLAT WIDE-ANGLE FAN-SHAPED BEAM OF X-RAYS

[75] Inventor: Emile Gabbay, Paris, France

[73] Assignee: Compagnie Generale de Radiologie, Paris, France

[21] Appl. No.: 82,691

[22] Filed: Oct. 9, 1979

Related U.S. Application Data

[63] Continuation of Ser. No. 871,994, Jan. 24, 1978, abandoned.

[30] Foreign Application Priority Data

Jan. 28, 1977 [FR] France ..... 77 02456

[51] Int. Cl.[3] ..... H01J 35/04

[52] U.S. Cl. ..... 378/125; 378/140; 378/203

[58] Field of Search ..... 250/406, 445 T; 313/60

[56] References Cited

U.S. PATENT DOCUMENTS

| | | | |
|---|---|---|---|
| 1,192,706 | 7/1916 | Thomson | 313/60 |
| 1,621,926 | 3/1927 | Fujimoto | 313/60 |
| 3,018,398 | 1/1962 | Atlee | 250/406 |
| 4,069,422 | 1/1978 | Hounsfield | 250/445 T |

*Primary Examiner*—Craig E. Church

*Attorney, Agent, or Firm*—Karl F. Ross

[57] ABSTRACT

A rotating-anode X-ray tube for producing a flat wide-angle fan-shaped beam with a substantially uniform distribution of energy comprises a cylindrical anode and a cathode axially or peripherally offset from the target area or focus bombarded by the electrons so that the axis of the fan-shaped beam emitted by that area can extend radially to the cylindrical anode surface. An arcuate shield closely paralleling this cylindrical surface is apertured at its center in front of the focus and intercepts stray electrons which would be liable to bombard the anode at points outside the target area so as to give rise to extra-focal radiation. Such a tube is useful in apparatus designed for axial transverse tomography.

6 Claims, 3 Drawing Figures

X-RAY TUBE FOR PRODUCING A FLAT WIDE-ANGLE FAN-SHAPED BEAM OF X-RAYS

This is a continuation of application Ser. No. 871,994, filed Jan. 24, 1978, now abandoned.

FIELD OF THE INVENTION

My present invention relates to a rotating-anode X-ray tube for producing in cooperation with collimating means such as a slit diaphragm, a flat wide-angle fan-shaped beam with a substantially uniform distribution of the radiating energy in a plane and in all directions within its angle of divergance. A beam source comprising a tube of this type is more particularly intended for a transverse-axial-tomography apparatus, also termed a tomodensimeter, having a row of X-ray detectors juxtaposed in the plane of the fan-shaped beam constituting the section plane so as to be capable of measuring the absorption of the object simultaneously in several directions.

BACKGROUND OF THE INVENTION

Tomodensimeters according to the state of the art employ conventional X-ray tubes with fixed or rotating anodes which generally comprise a linear cathode surrounded by an electron concentrator and producing an electron beam of rectangular section parallel to the axis of the anode. Generally, the anode surface is beveled or frustoconical so that its generatrices are inclined, on the one hand, relative to the electron beam bombarding it and, on the other hand, relative to the useful beam of X-rays obtained by collimation (by means of a diaphragm) of the radiation emitted by the bombarded surface portion, termed the focus or target area. It has been found that the distribution of the energy of the emitted radiation as a function of its angle relative to the surface normal at the target area is not uniform and that in the anode-cathode plane, defined by the axes of the anode and the cathodic filament, this distribution of radiated energy varies considerably, with a maximum of emission in the direction of the aforementioned surface normal.

Another drawback of the use of these beveled anodes for producing a wide-angle fan-shaped radial beam for irradiating a row of detectors, is that the projection of the real focus or target area on the rectangular face of each of these detectors i.e. the virtual focus, undergoes a distortion which increases with the mean angular deviation from the surface normal so that the detectors located at the ends of the row see only a small part of the virtual focus and consequently receive only a small part of the radiated energy.

In order to compensate for these defects, certain electronic means have been developed. In the present state of the art, X-ray tubes are also employed which comprise a rotating anode whose frustoconical or beveled surface is bombarded by an electron beam of elongated section (practically filiform), oriented radially relative to the axis of rotation of the anode and forming on the frustoconical surface of the latter an elongate thermal focus coinciding with a generatrix of the conical surface. The radiation emitted by this focus is collimated in such manner as to select the rays emitted about the tangent to the frustoconical surface in the region of the thermal focus so as to obtain a fan-shaped radiation with an energy distribution which is more uniform than with conventional substantially pin-point sources employing the same type of tube. As this uniformity is still insufficient, owing to the variation of the angle at which the rays emerge, the use of a wedge-shaped attentuator for compensating for this defect has been proposed.

Further, in these X-ray tubes, when the anode is bombarded by the electron beam, a certain number of secondary electrons are emitted from the thermal focus and are reaccelerated in the anode-cathode space, being thus liable to bombard the anode at points outside the target area and to produce an X-ray radiation, termed an extra-focal radiation, which has an adverse effect on the quality of the desired flat fan-shaped X-ray beam.

OBJECTS OF THE INVENTION

An object of the present invention is to provide an X-ray tube for producing a planar wide-angle fan-shaped beam having an energy distribution which is substantially uniform throughout its width without requiring the aforementioned attenuation-type compensating means.

Another object of my invention is to provide a tube of this type whose virtual focus has no notable deformation in any direction within the useful fan shape, so that the projection of the thermal focus or target area on the input faces of the detectors is practically without deformation and retains its elongated rectangular shape irrespective of the mean angular position of the part of the beam striking them.

It is also an object of my invention to provide means in, the X-ray tube for reducing the extra-focal radiation and thereby still further improving the quality of the emitted beam.

SUMMARY OF THE INVENTION

In accordance with my present invention, an X-ray tube for a radiodiagnostic apparatus, having a rotating anode with an X-ray-emissive cylindrical surface centered on an axis in a vacuum-tight envelope, has its cathode offset from a radial line normal to the target area toward which a beam of electrons is emitted by the cathode, the usual collimating means for converting emitted X-ray radiation into a planar fan-shaped beam being a slitted diaphragm disposed in a plane transverse to the anode axis which includes that radial line. Thus, the beam shaped by the collimating means spreads within this radial plane into the desired fan shape.

According to another important feature of my invention, the anode is at least partially enshrouded by shield means closely paralleling its cylindrical surface in the vicinity of the target area for intercepting stray secondary electrons, the shield means having an aperture in line with the diaphragm slit confronting the target area for giving passage to the electron beam emitted by the cathode and to the X-ray radiation emitted from the target area.

In conformity with conventional practice, the cathode may be located in a tubular neck forming an extension of the envelope. This neck, pursuant to my invention, preferably has a centerline which includes an acute angle with the radial line normal to the target area. As more particularly described hereinafter, this centerline my lie either in the transverse plane containing the collimating means or in an axial plane of the anode including the aforementioned radial line. In either case, the electron beam initially approaches that radial line and is then deflected through the shield aperture onto the target area.

BRIEF DESCRIPTION OF THE DRAWING

The above and other features of my invention will now be described in detail with reference to the accompanying drawing in which.

In all these Figures like references designate like elements.

SPECIFIC DESCRIPTION

Figure 1:
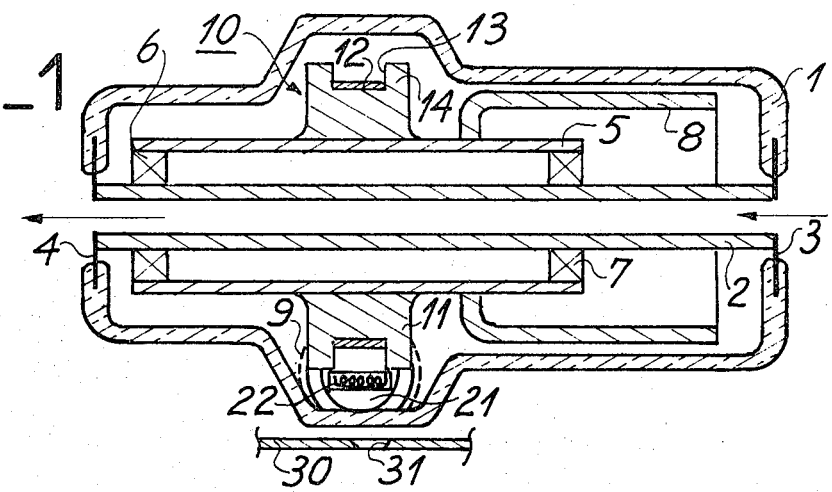
FIG. 1 is an elevational sectional view of a first embodiment of an X-ray tube according to the invention.

FIG. 1 shows a first embodiment of a X-ray tube according to the invention in axial section. In this Figure, the X-ray tube comprises a glass envelope 1 having a generally cylindrical shape whose ends are connected in an ultra-vacuum-tight manner (by means of discs 3 and 4 of a conventional alloy of a metal having a coefficient of thermal expansion close to that of the glass) to corresponding ends of a hollow metal shaft 2 which permits the circulation of a cooling fluid in the direction of the arrows.

Journaled on the hollow shaft 2 by means of ball bearings 6 and 7 is a tubular metal shaft 5 to which there are fixed a cylindrical copper rotor 8 disposed in a rotating field, produced by a stator (not shown) which is fitted in a conventional manner on the envelope 1, and a rotating anode 10 which has a cylindrical surface whose generatrices are parallel to its axis of rotation as is known per se.

The rotating anode 10 has a cylindrical body 11 of an electrically conductive material (of a metal such as, for example, copper or molybdenum, or of graphite) at least the surface of which, bombarded by a beam of electrons, is covered with a layer 12 of a material which emits X-rays, such as tungsten.

It is also possible to make the entire body 11 of this X-ray-emitting metal.

In conventional cylindrical-rotating-anode X-ray tubes, the cathode filament is disposed in front of the cylindrical surface in such manner as to emit an electron beam perpendicular to the surface and consequently to the axis of rotation of a anode. An arrangement of this type has the same drawbacks as the tube having a frustoconical anode, since the useful beam of X-rays includes an angle close to 90° with the normal to the target area, that is to say, the useful beam has a small angular deviation from the plane tangent to the focus (of the order of 6° to 10°) and consequently a highly non-uniform energy distribution.

Figure 2:
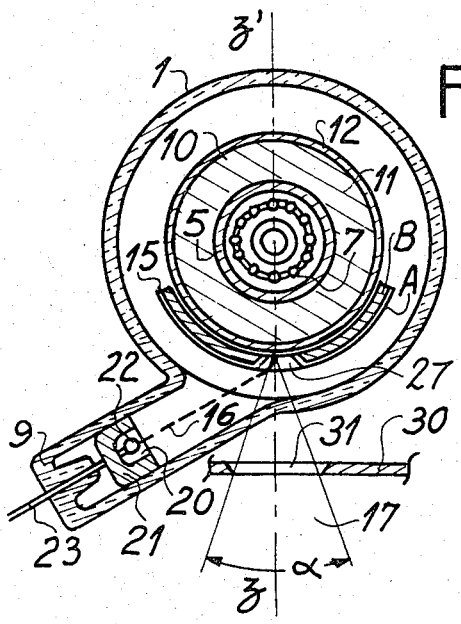
FIG. 2 is a cross-sectional view of a modification of the embodiment of FIG. 1.

In the X-ray tube according to the invention, the cathode 20, comprising a filament 22 and an element 21 for concentrating the electrons, is laterally offset from the anode 10 so that the space in front of the thermal focus is left free and the axis of the X-ray beam may be substantially normal to the target area and consequently perpendicular to the axis of rotation of the anode. This arrangement, best seen in FIG. 2, provides a planar, wide-angle, fan-shaped beam 17 of vertex angle $\alpha > 60°$ with a substantially uniform distribution of the radiated energy and with rectangular virtual foci throughout the fan shape. The beam 17 is bisected by a plane z–z′ including the anode axis.

For this purpose, the cathode 20 is disposed in a projecting tubular neck 9 having an end which is closed in a sealed manner and through which extend sealed and conductive leads 23 which are embedded in the end of the neck and serve to support the filament 22 and the cup-shaped electron concentrator 21 and to supply them with operating current. The two leads 23 supporting the ends of the filament 22 extend through the end of the cup-shaped concentrating element 21 and are surrounded by insulating sleeves 24 (see FIG. 3) so as to permit the application to the element 21 of a biasing voltage which is negative relative to the potential of the filament 22.

I may construct the envelope 1 from a metal which is either substantially transparent to the useful X-rays or provided on the part thereof facing the target area with a window (not shown) of an X-ray-transparent material such as glass or a ceramic which is sealed, for example by brazing, to the metal envelope 1.

In this embodiment (FIG. 1) the focal track 12 is disposed in a recess constituted by an annular groove 13, bounded by two projecting flanges or collars 14, whereby the extra-focal radiation may be markedly reduced, the emitting layer 12 covering the bottom of the groove 13 of the generally spool-shaped anode 10.

FIG. 2 shows a modification, in axial section, of the embodiment of FIG. 1.

Here, the anode no longer has the shape of a spool but is perfectly cylindrical and provided with a suppressor of extra focal radiation according to another feature of the invention which is much more effective than the edge beads 14 flanking the conventional recess 13 of FIG. 1.

The radiation suppressor 15 is an arcuate shield which is centered on the axis of revolution of the rotating anode 10 and closely parallels the cylindrical surface of this anode. The center of the shield is apertured at 27 so as to leave a free passage for the incident electron beam 16 and for the beam of radiating energy emitted from the focus.

The shield 15 comprises two layers A and B. The outer layer A is made of light material, such as graphite or titanium, and serves to absorb by a retarding action on its outer face the secondary electrons which are released by the impact of the main beam on the target area and which, when reaccelerated, might bombard the anode at points outside that area so as to produce an extra-focal radiation.

The inner layer B consists of a material of high atomic number, such as tungsten, so as to absorb the X-radiation emitted at points of the anode other than the focus.

The thickness of layer A depends on the maximum operating voltage of the tube and should be so chosen that the residual X-radiation produced by the bombardment of the secondary electrons on this layer is negligible.

The thickness of layer B depends on the extra-focal radiating energy to be absorbed and therefore also on the maximum operating voltage of the tube.

In order to obtain optimum efficiency, this shield has its inner layer B located very close to the cylindrical surface of the anode, for example a few tenths of a millimeter therefrom.

The sole source of X-rays is therefor limited to a surface area of the anode having a width corresponding to that of the aperture 27 of the shield 15 and a length equaling at most the breadth of the cylindrical anode. This source produces a fan-shaped X-radiation 17.

In the embodiment of FIG. 1 the first embodiment of an X-ray axis of the neck 9, and consequently the axis of the beam of electrons bombarding the anode track 12, is located in the radial plane of the anode containing the beam of X-rays emitted by the track. The neck axis constituting the centerline of the electron source 21, 22 is skew to the anode axis so that a free space remains in front of the focus enabling the emplacement of a diaphragm 30 having a rectangular slit 31 which is also skew to the anode axis and lies as close as possible to the X-ray-emitting focus. In this first embodiment, the coiled filament 22 is oriented parallel to the axis of the anode 10 so that the elongated (quasi-linear) rectangular focus on the focal track 12 substantially coincides which a generatrix of its cylindrical surface.

The orientation of the axis of the neck 9 is shown in FIG. 1 as being substantially perpendicular to a generatrix of the surface of the anode 10, no supplementary electrode or magnetic coil for deflecting or focusing the electron beam being provided.

However, this orientation of the neck 9 at right angles to the axis of the X-ray beam, while allowing the diaphragm 30 to approach the anode to the maximum extent, is not necessarily the most advantageous from the point of view of the fineness of the linear focus since the electric field acting on the electrons moving between the cathode 20 and the anode 10 does not eliminate the effect of the Gaussian dispersion of the energies of the electrons leaving the filament, which is manifested by a broadening of the focus.

Thus, I may orient that it is possible to employ in this embodiment the axis of the neck 9 at an acute or obtuse angle with respect to the axis of the X-ray beam which is normal to the target area and, in the latter case, may utilize conventional means (not shown) for deflecting and concentrating the electron beam, as known in electron optics, whereby the electrons approaching the plane z–z′ are caused to impinge substantially perpendicularly upon the focal track 12 by way of shield aperture 27.

The axis of the neck 9 is shown oriented in FIG. 2 in conformity with the embodiment of FIG. 1, i.e. skew to the anode axis, but includes an acute angle with the axis of the X-ray beam which is normal to the target area so that the aperture 27 of the shield 15 giving access to the bombarding electron beam could be very narrow in order to limit as far as possible the extra-focal radiation.

Figure 3:
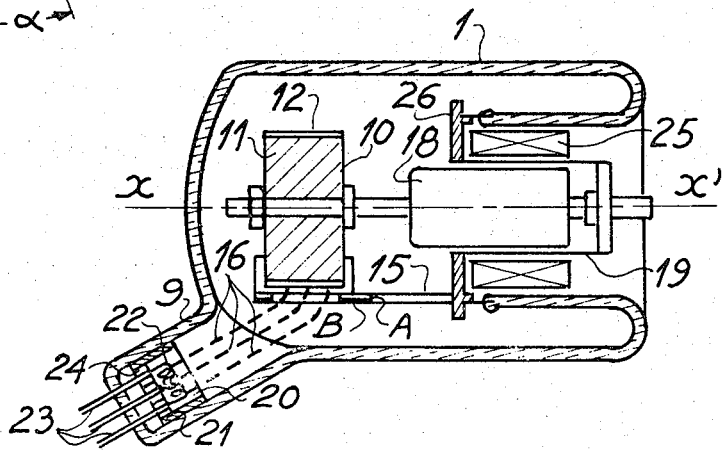
FIG. 3 is an axial sectional view of a second embodiment of a tube according to the invention.

FIG. 3 shows an axial sectional view of a second embodiment of an X-ray tube according to the invention in which the cathode 20 is offset from the anode 10 in a direction parallel to the axis of rotation thereof indicated at x–x′. Thus, the axis of neck 9 is inclined relative to the radial plane containing the fan-shaped X-ray beam; the diaphragm serving to shape the beam has not been illustrated in this Figure.

The electron beam 16 emitted by the axially offset cathode is inclined at an acute angle to the axis of rotation x–x′ of the anode 10 in a plane defined by this axis and the normal to the target area forming part of the cylindrical surface 12. In order to obtain a quasi-linear focus coinciding with a generatrix of the anode surface 12, the centerline of the filament 22 and of the cavity of the concentrating cup 21 containing that filament is located in the plane of offset and so oriented as to pass substantially through the center of the focus. This plane of offset, as will be apparent from the drawing, is defined by the anode axis x–x′ and the surface normal of the target area.

In FIG. 3, the rotating anode is supported by a rotor 18 centered on the axis x–x′ and supported by a metal disc 26, the vacuum-tight connection of the latter with the rotor being ensured by a thin metallic rotating sleeve 19. The rotor 18 is located in a rotating field produced by a stator 25 having the same potential as the anode.

The shield 15, provided with the two layers A and B, is integral with the metal disc 26 supporting the rotor along with the anode and is maintained at the same potential as anode 10. As in the embodiment of FIG. 2, the electron beam 16 is deflected away from the axis of neck 9 in order to pass through the shield aperture to the target area of track 12.

Besides reducing the extra-focal radiation, shield 15 may have the function of absorbing the thermal radiation from the anode. In this case, the surface of the shield facing the anode is extended to cover the entire cylindrical surface of the anode and also the two circular end faces thereof. The shield consequently has the shape of a hollow cylinder enshrouding the anode, its cylindrical and circular surfaces being respectively parallel to the cylindrical and circular surfaces of the anode.

The heat is then carried off by means of a cooling fluid circulating in the shield. This fluid may be for example water or oil, depending on the operating potential of the anode (ground or positive high voltage).

The X-ray tubes according to the present invention may be used in transverse-axial-tomography apparatus comprising a row of numerous radiation detectors all of which are irradiated simultaneously by a wide-angle fan-shaped beam.

The anode 10 may be driven in rotation by any known means other than those described hereinbefore.

What is claimed is:

1. In a radiodiagnostic apparatus, in combination:

an X-ray tube comprising a rotating anode with an X-ray-emissive cylindrical surface centered on an axis in a vacuum-tight envelope;

shield means in said envelope enshrouding at least part of said anode while closely paralleling said cylindrical surface, said shield means having an aperture confronting a target area of said cylindrical surface;

means in said envelope including a cathode offset from a radial line normal to said target area for generating an electron beam approaching said radial line;

electron-optical means for deflecting said beam through said aperture onto said target area whereby the latter emits X-radiation traversing said aperture; and a diaphragm separated by said shield means from said cylindrical surface and disposed in a plane transverse to said axis including said radial line, said diaphragm having a slit in said transverse plane aligned with said aperture for letting said X-radiation spread within said plane into a fan-shaped beam adapted to illuminate an array of X-ray detectors.

2. The combination defined in claim 1 wherein said shield means comprises an inner layer of heavier X-ray-absorbing material and an outer layer of lighter electron-absorbing material.

3. The combination defined in claim 1 or 2 wherein said envelope forms a metallic support for said anode, said shield means being carried on said support and maintained at the same potential as said anode.

4. The combination defined in claim 1 wherein said cathode is located in a tubular neck forming an extension of said envelope, said neck having a centerline including an acute angle with said radial line.

5. The combination defined in claim 4 wherein said centerline lies in said transverse plane.

6. The combination defined in claim 4 wherein said centerline lies in an axial plane of the anode including said radial line.

* * * * *